US009422716B2

(12) United States Patent
Chandra et al.

(10) Patent No.: US 9,422,716 B2
(45) Date of Patent: Aug. 23, 2016

(54) COMPOSITE ACTION SUPPORT STRUCTURES

(71) Applicant: PBC International Inc., New York, NY (US)

(72) Inventors: Vijay Chandra, Fairfax Station, VA (US); John Sang Kim, Midlothian, VA (US)

(73) Assignee: PBC International Inc., New York, NY (US)

( * ) Notice: Subject to any disclaimer, the term of this patent is extended or adjusted under 35 U.S.C. 154(b) by 116 days.

(21) Appl. No.: 14/218,007

(22) Filed: Mar. 18, 2014

(65) Prior Publication Data

US 2014/0259463 A1 Sep. 18, 2014

Related U.S. Application Data

(60) Provisional application No. 61/793,382, filed on Mar. 15, 2013.

(51) Int. Cl.
*E01D 2/02* (2006.01)
*E04C 3/28* (2006.01)
(Continued)

(52) U.S. Cl.
CPC . *E04C 3/28* (2013.01); *E01D 19/00* (2013.01); *E01D 2101/40* (2013.01); *E04B 5/026* (2013.01); *Y10T 29/49634* (2015.01)

(58) Field of Classification Search
CPC ..... E01D 2/02; E01D 2101/40; E04C 3/28
USPC ..... 14/74.5, 77.178; 52/309.1
See application file for complete search history.

(56) References Cited

U.S. PATENT DOCUMENTS 4,604,841 A * 8/1986 Barnoff ..... E01D 2/02 14/73
5,789,477 A 8/1998 Nosker et al.
(Continued)

FOREIGN PATENT DOCUMENTS

KR 0100496735 B1 6/2005
RU 1821509 A1 6/1993
(Continued)

OTHER PUBLICATIONS

Wang, Linan; Gong, Chao, "Abutments and Retaining Structures," Chapter 29, Bridge Engineering Handbook, Boca Raton: CRC Press, 2000, 37pgs.
(Continued)

*Primary Examiner* — Gary Hartmann
(74) *Attorney, Agent, or Firm* — Duane Morris LLP

(57) ABSTRACT

A composite action support structure for a bridge or other civil infrastructure includes an elongate member made of a plastic material and providing load bearing capability. A cover plate is made of a plastic material and extends along at least a portion of the length of the elongate member. A lower surface of the cover plate is mated to the upper surface of the elongate member. A plurality of panels made of a plastic material are arranged at an angle to the cover plate, and a lower surface of each of the panels mates with an upper surface of the cover plate. The elongate member, the cover plate and the plurality of panels form a structural unit. The plastic materials used can include virgin plastic, thermoplastic, recycled thermoplastic composite, recycled structural composite, combinations thereof, and the like.

20 Claims, 6 Drawing Sheets

(51) Int. Cl.

| | |
|---|---|
| *E01D 19/00* | (2006.01) |
| *E04B 5/02* | (2006.01) |
| *E01D 101/40* | (2006.01) |

(56) References Cited

U.S. PATENT DOCUMENTS

| | | | | |
|---|---|---|---|---|
| 5,916,932 | A | 6/1999 | Nosker et al. | |
| 6,191,228 | B1 | 2/2001 | Nosker et al. | |
| 6,557,201 | B1 * | 5/2003 | Bowman | B29C 70/443 14/2.4 |
| 6,568,139 | B2 * | 5/2003 | Bot | E01D 19/125 52/125.5 |
| 6,826,884 | B2 * | 12/2004 | Pabedinskas | E04C 3/28 52/839 |
| 7,011,253 | B2 | 3/2006 | Nosker et al. | |
| 7,795,329 | B2 | 9/2010 | Nosker et al. | |
| 7,996,945 | B2 | 8/2011 | Nosker et al. | |
| 8,008,402 | B2 | 8/2011 | Lynch et al. | |
| 8,069,519 | B2 * | 12/2011 | Bumen | B28B 23/024 14/73 |
| 2009/0242655 | A1 | 10/2009 | Nosker et al. | |
| 2010/0319144 | A1 | 12/2010 | Nosker et al. | |
| 2011/0265410 | A1 | 11/2011 | Nosker et al. | |
| 2011/0294917 | A1 | 12/2011 | Lynch et al. | |

FOREIGN PATENT DOCUMENTS

| | | | |
|---|---|---|---|
| RU | 2005837 | C1 | 1/1994 |
| RU | 2299945 | C1 | 5/2007 |
| RU | 87712 | U1 | 10/2009 |
| SU | 1183597 | A | 10/1985 |
| WO | 02/29160 | A1 | 4/2002 |

OTHER PUBLICATIONS

Schut, Jan H., "They've Been Working on the Railroad," Plastics Technology, Apr. 2004, pp. 1-5.

International Searching Authority, International Search Report, PCT International Application No. PCT/US2013/061689 mailed Jan. 30, 2014, 1pg.

International Bureau (International Searching Authority), International Preliminary Report on Patentability for International Application No. PCT/US13/061689 issued Mar. 31, 2015, 11pgs.

International Searching Authority, International Search Report for corresponding PCT International Application No. PCT/US2014/030997, mailed Aug. 7, 2014, 1pg.

* cited by examiner

COMPOSITE ACTION SUPPORT STRUCTURES

This application claims the priority benefit of U.S. Provisional Patent Application No. 61/793,382, filed Mar. 15, 2013, the entirety of which is hereby incorporated by reference.

FIELD

This disclosure relates generally to composite action support structures, and more specifically to composite action support structures for civil infrastructure such as a bridge.

BACKGROUND

Civil infrastructure, and particularly transportation and utility infrastructure require bearing heavy loads. For example, bridges support heavy vehicles, such as trains, cars and trucks by spanning an underlying stream, path, roadway, railway or the like. The structures used in bridges and other civil engineering structures have long been designed using traditional materials, predominantly reinforced concrete, steel and timber. Over time, the extended use and testing of these materials, and the structures built with them, has resulted in a substantial knowledge base of their material properties, and the properties of structures built with them. This knowledge base includes standards, codes, reference material, design texts and general knowledge in the design community pertaining to the conventional materials. This knowledge has, in some respects, hindered the development of new designs using new materials. For example, unconventional materials, such as plastics have been disfavored in part because many applicable civil engineering designers do not know or have access to the same type of knowledge base as is available for steel, concrete and timber. Unconventional materials have further been disfavored in part because of perceived, and misperceived, challenges and differences between the materials and conventional materials, such as perceived differences in strength, temperature effects, and reactions to exposure, such as the effects of prolonged exposure to sunlight. It would be advantageous to realize the benefits of new materials and new designs using such materials, while overcoming or ameliorating one or more of the deficiencies of prior art structures.

It would be beneficial to reduce the complexity of construction of civil infrastructure such as bridges, platforms, retaining walls and other transportation and utility structures. Needed are structural modules for civil infrastructure that do not have the extent and nature of deficiencies of prior art support structures. Needed are structural modules and methods for using them in constructing civil infrastructure having lower initial costs of manufacturer, as well as lower total costs of ownership. Needed is civil infrastructure having lower adverse environmental impact.

DETAILED DESCRIPTION

Figure 1:
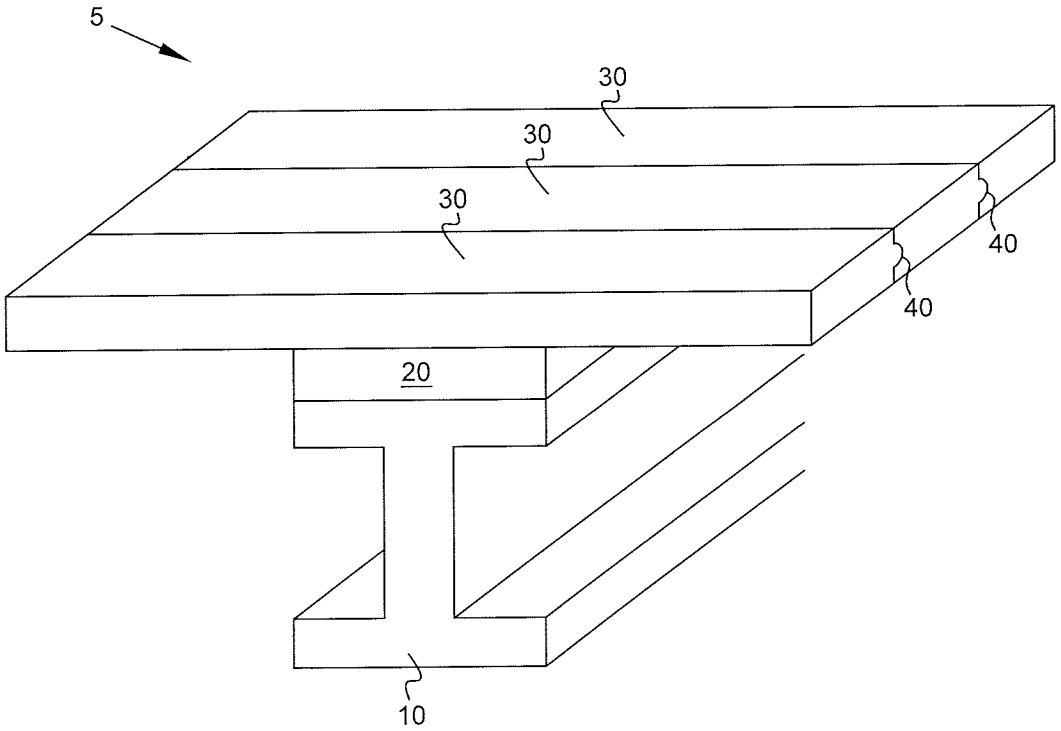
FIG. 1 is a perspective view of a composite action support structure in accordance with some embodiments of the invention.

Technical details of various disclosed examples and embodiments will now be described, it being understood that the present invention is broader than any particular example or embodiment. Technical details are provided for teaching purposes only and should not be considered in any way as a limitation on the scope of the invention. Although reference herein is made to structures in the context of bridges, one of ordinary skill in the art will recognize that the structures and methods are applicable to civil structures used for other purposes. While reference is made here to orientations such as up, down, top and bottom, one of ordinary skill in the art will be able to apply the teachings herein to other orientations. Like reference numerals in the various figures refer to like components.

Thermoplastics are materials, particularly resins, that repeatedly soften when heated and harden when cooled. Some examples of thermoplastic resins include styrene, acrylics, cellulosics, polyethylenes, vinyls, nylons and fluorocarbons. Recently, applicants have begun designing load bearing rail and roadway bridges using thermoplastics, and, more specifically, recycled thermoplastics, in a manner not previously accomplished. Applicants have been able to use these new materials to design bridge structures such as piles, pile caps, and girders.

One such thermoplastic, referred to as recycled structural composite or RSC, is manufactured by Axion International Holdings, Inc. Axion manufactures structural composites in forms such as the I-Beam 10 shown in FIG. 1. Recycled plastic composites (such as RSC) suitable for use with the present invention are disclosed in U.S. Patent Application Publication No. 2011/0294917 to Lynch et al., published on Dec. 1, 2011, the entirety of which is hereby incorporated by reference. In particular, Lynch discloses the use of a recycled plastic structural composite formed from a mixture of high density polyolefin together with one or both of a thermoplastic-coated fiber material and a polystyrene, poly methyl methacrylate. Other suitable composites are known or can be found in the literature and applied based on the teachings herein.

Applicants designed railroad bridges using RSC structural components that were field tested in Fort Eustis, Va. in the Spring of 2010. The Fort Eustis bridges were approximately 40 feet and 80 feet long with a load capacity of approximately 130 tons, with a Cooper E-60 rating. The bridge structures including the piles, span girders, and rail ties were made from nearly 100 percent recycled post-consumer and industrial plastics.

Preferably, the thermoplastic materials have distinct advantages as compared to conventional materials in that they are less susceptible to decay, such as the rotting experienced in timber structures, less susceptible to oxidation and corrosion, such as the rust experienced in steel and reinforced concrete structures, and are impervious to insects, such as those that threaten timber structures. Environmental benefits of thermoplastics include that the material is inert and will not leach, or is much less susceptible to leaching, potentially harmful chemicals into the environment. This may be particularly beneficial, for example, when building bridges near or on waterways, and critical for projects near wetlands or other protected bodies of water.

FIG. 1 depicts a perspective view of a composite action support structure 5 in accordance with some embodiments of the invention. The composite action support structure 5 includes deck panels 30, cover plate 20, and I-Beam 10. FIG. 1 is a partial view of the length of I-Beam 10 and cover plate 20. Further deck panels (not shown) continue on the not shown portions of the length of the I-Beam 10 and cover plate 20. The major components of composite action support structure 5, including deck panels 30, cover plate 20 and I-Beam 10, are formed from a plastic material selected from the group of: virgin plastic, recycled plastic, thermoplastic, recycled plastic composite, RSC, combinations of the forgoing, and the like. In some embodiments, the materials are all RSC, and the I-Beam 10 is an 18" I Beam girder, the cover plate 20 is a 3" thick cover plate, and the deck panels 30 are 6" thick. Other dimensions can be used according to the particular design needs of a given structure. Additional materials may be layered on top of the deck panels to form a civil engineering structure. As is known for constructing a bridge for vehicles, for example, the following layers (not shown) may be formed on top of the deck panels 30: a waterproof membrane, an aggregate base and an asphalt concrete overlay. I-Beam 10 advantageously resists deflection. While reference is made herein to the example of an I-beam, other elongate, exemplary structures may be used, such as T-beams, C-channel beams, L shaped angle beams, combinations thereof and the like. For example, in some embodiments two T-beams may be joined together to form a composite action I-beam.

Figure 5:
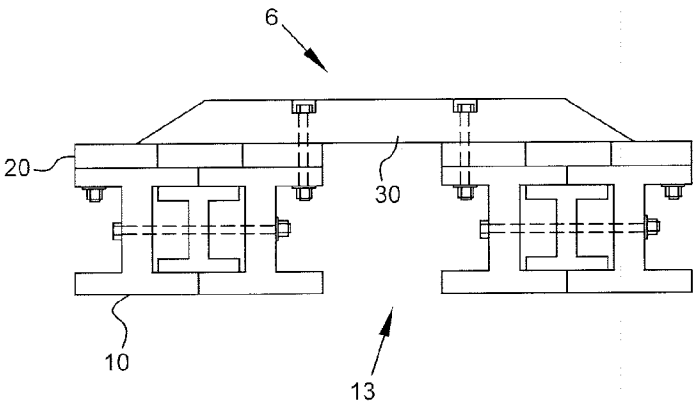
FIG. 5 is a sectional view of a second one of the modular composite action support structures shown in FIG. 3.

Deck panels 30 are positioned at an angle to, and supported by, cover plate 20. As shown in FIG. 5, deck panels 30 can be positioned orthogonally to cover plate 20. Cover plate 20 is positioned on top of, and supported by, I-Beam 10. The upper surface of cover plate 10 mates and engages with the lower surfaces of the deck panels 30. The lower surface of cover plate 20 mates and engages with the upper surface of I-Beam 10. Thus, deck panels 30 are also disposed at an angle to, I-Beam 10. In some embodiments, the components of structure 5 are further secured together, or mated, using stainless steel bolts, resin, epoxy, glue or the like, as appropriate for the materials and application intended. The components of composite action support structure 5 are thus bound together so that, structurally, they act together as a single unit, and may be analyzed as such. Advantageously, use of cover plate 20 permits deeper structures than would otherwise be permitted by the restrictions, such as manufacturing capabilities, of the non-conventional materials used. For example, if manufacturing capabilities or other implementation issues limit the size of I-Beam 10, cover plate 20 permits construction of a composite action support structure as if a larger I-Beam 10 were available. Cover plate 20 reduces the deflection of I-Beam 10 for a given applied force. Deck panels 30 may have respective engaging tongue and groove portions 40 to increase the strength of their joined surfaces. Preferably, the effective width of I-Beam 10 is engaged with the cover plate 20. Integrating deck panels 30 with cover plates 20 and I-Beam 10 provides improved structural properties, reduces deflection due to imposed dead and live loads and improves durability of the entire module.

Figure 2:
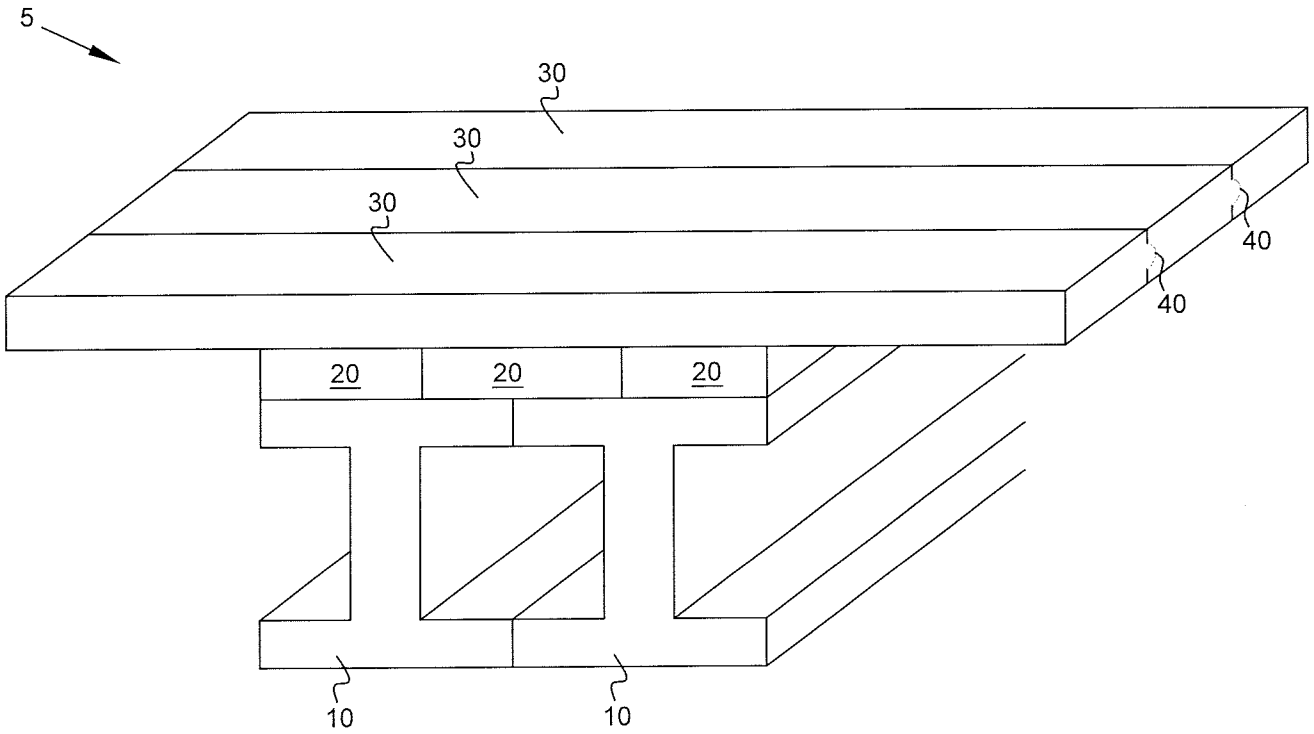
FIG. 2 is a perspective view of a composite action support structure in accordance with some embodiments of the invention.
Figure 6:
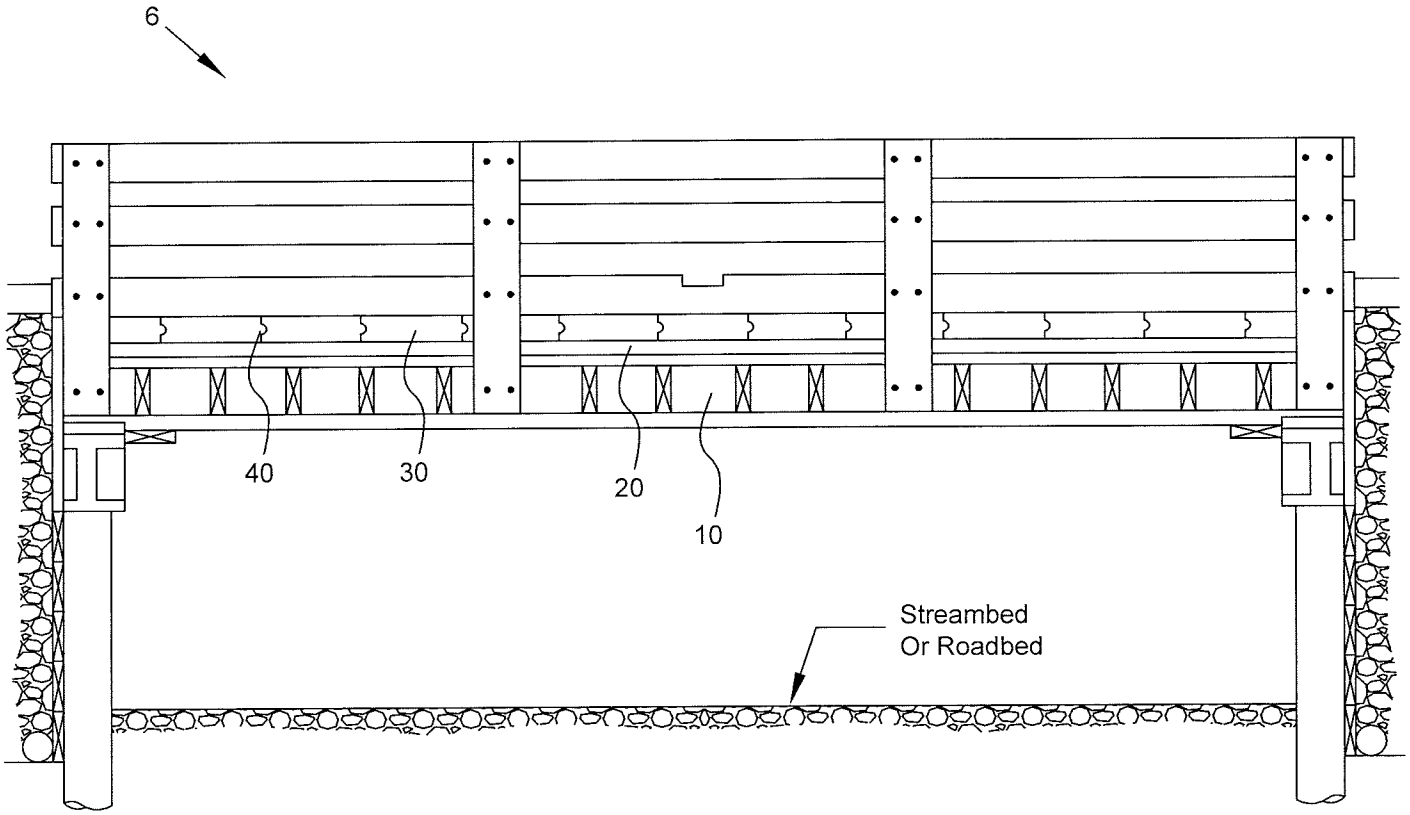
FIG. 6 shows an elevation side view of a bridge having at least one modular composite action support structure in accordance with an embodiment of the invention.

FIG. 2 depicts some embodiments of a composite action support structure 5. Similar to embodiments illustrated by FIG. 1, the composite action support structure 5 in FIG. 2 comprises deck panels 30, cover plates 20, and I-Beams 10. As shown, cover plates 20 may overlap the upper surface of two or more I-Beams 10. In the embodiment shown, two I-Beams 10 support three cover plates 20, and a plurality of deck panels 30. As with FIG. 1, FIG. 2 is a partial view of the length of I-Beams 10 and cover plates 20. As shown in FIG. 6, further deck panels 30 continue down the length of the I-Beams 10 and cover plates 20.

Figure 3:
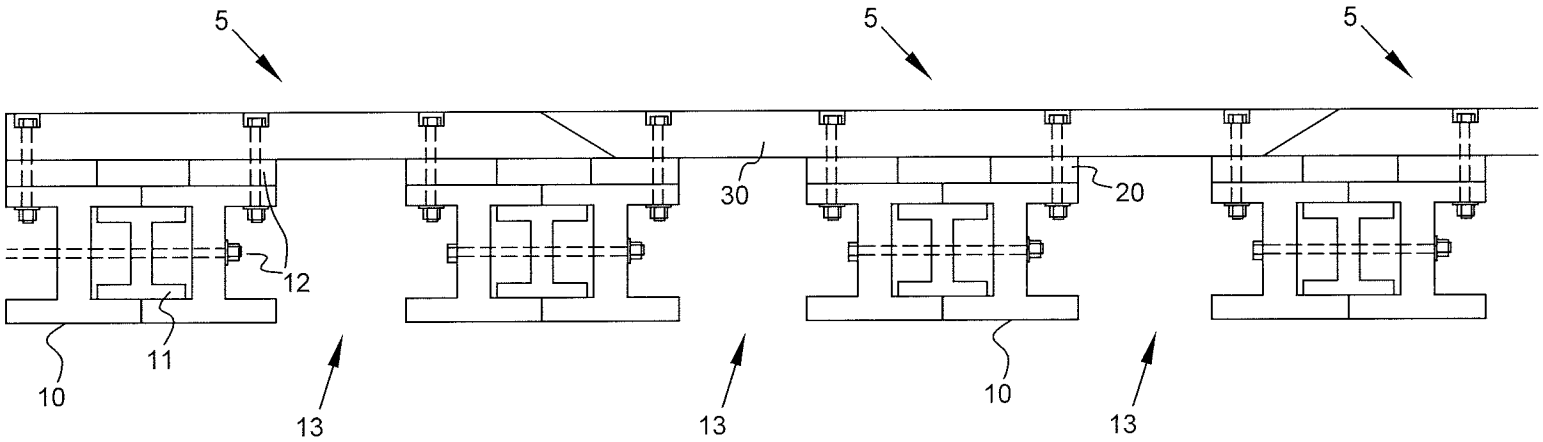
FIG. 3 is a sectional view of a plurality of modular composite action support structures in accordance with an embodiment of the invention.
Figure 4:
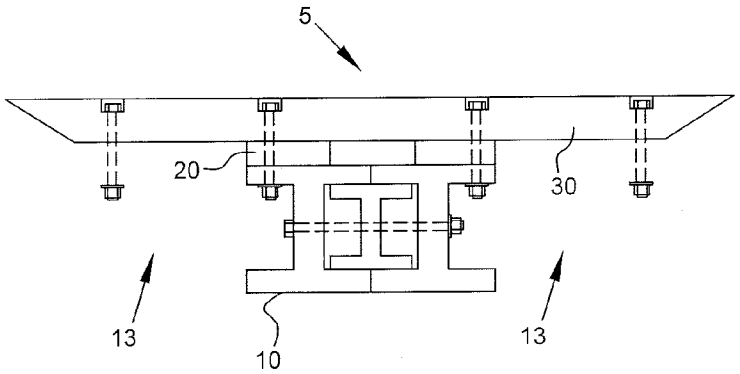
FIG. 4 is a sectional view of a first one of the modular composite action support structures shown in FIG. 3.

FIG. 3 depicts a plurality of modular composite action support structures 5, each of which having a set of I-Beams 10, cover plates 20 and deck panels 30. For strength and stability, smaller I-Beams 11 may be nested within I-Beams 10. Steel bolts 12 increase the strength of the composite action for each structure 5. Likewise, the end faces of deck panels 30 may be beveled for engagement with the adjacent beveled end faces of deck panels 30 of an adjacent structure 5. In some embodiments, modular composite action support structures 5 have gaps 13 below deck panels 30, i.e., one or more voids where the deck panels 30 do not have an I-Beam 10 directly underneath them. In the composite action support structure 5 shown in FIG. 4, composite action support structure 5 has gaps 13 on either side of the pair of I-Beams 10 that are providing the primary support to deck panels 30. As depicted in FIG. 4, the combined distance of the two gaps along the length of deck panels 30 is about twice the width of one of the I-Beams 10. In some embodiments, such as the composite action support structure 5 shown in FIG. 5, there is one gap, and it extends a distance along deck panels 30 that is equal to or greater than the width of one I-Beam 10. One of ordinary skill in the art will appreciate that the appropriate amount of spacing between I-Beams 10 will vary according to design constraints, consistent with the teaching herein. The spacing between the I-Beams 10 can be increased as compared to prior designs, without significant loss of strength or stability. Fewer I-Beams can be used and still meet a given design requirement. All of these advantages have corresponding benefits, such as reduced cost, weight and materials.

FIGS. 4 and 5 illustrate, respectively, two forms of the modular composite action support structures 5 shown in FIG. 3. FIG. 6 depicts a side view of a short-span bridge 6 spanning a stream or road constructed using composite action support structures 5. Illustrated is the side of one composite action support structure 5, showing the end faces of a plurality of deck panels 30, a side face of a cover plate 20, and the side of an I-Beam 10. The abutments and other structures for the bridge shown in FIG. 6 may likewise be formed from non-conventional materials, such as disclosed in U.S. patent application Ser. No. 14/036,864, the entirety of which is hereby incorporated by reference.

In some embodiments, a bridge like the one depicted in FIG. 6 is constructed using modular composite support action structures 5. Advantageously, the modular composite action support structures can be assembled in advance, in full or in part, prior to the time that the bridge is constructed. Such advance assembly can also occur remotely from the construction site of the actual bridge, and can be transported to the construction site at the appropriate time as a module.

Figure 7:
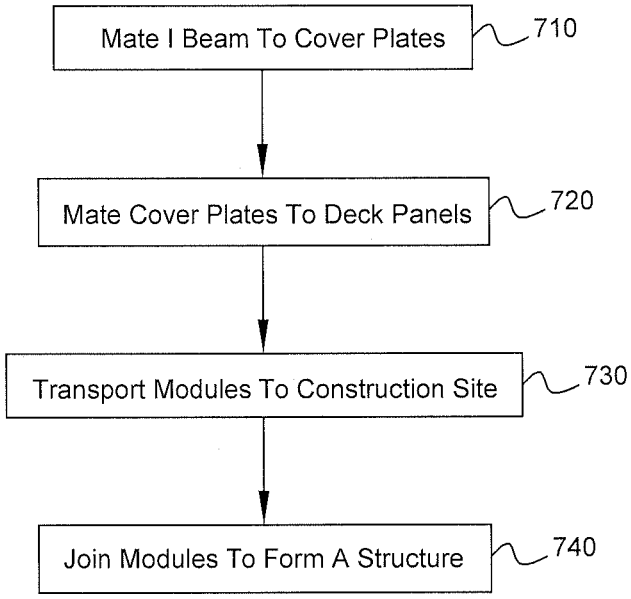
FIG. 7 shows a flow diagram of a method of constructing civil infrastructure in accordance with an embodiment of the invention.

FIG. 7 illustrates some embodiments of a staged process to make a composite action support structure 5 (as shown in any of FIGS. 1-6), and then use it to construct civil infrastructure such as the bridge shown in FIG. 6. At step 710, the upper surfaces of one or more I-Beams 10 are mated to a portion of the lower surfaces of one or more cover plates 20. In step 720, at least a portion of the lower surfaces of deck panels 30 are mated to the upper surfaces of cover plates 20, thereby forming a modular composite action support structure 5. Steps 710 and 720 can be repeated to make multiple modules. In step 730, the modules can be transported to the construction site of civil infrastructure, such as the site of the stream crossing depicted in the bridge of FIG. 6. In step 740, the modules can be joined together at the construction site to form a larger, load-bearing structural unit, such as is shown in FIGS. 3 and 6. The modular nature of the composite action support structures 5 can advantageously reduce the cost, time and effort that must occur at the site of the construction. The advantage can be significant. Consider, for example, a construction project that requires interrupting transportation during the time that a bridge is constructed. If modules of the bridge can be built in advance, the duration of the interruption can be reduced. Likewise, if modules of the bridge can be constructed at a remote location, resources required at the construction site can be reduced.

The disclosed embodiments remove or reduce the deficiencies of the prior art as discussed above. Certain embodiments permit the advantages of plastics to be realized for composite action support structures. Certain embodiments show structural designs in which an I-Beam or similar load bearing girder may be formed into a larger, stronger unit through the addition of extra thickness provided by one or more cover plates mated to the upper surface of the I-Beam. Deck panels may be further mated to the cover plates to form the composite action support structure. Multiple, composite action support modules may be formed so as to provide a way to build civil infrastructure such as a bridge, platform or retaining wall in a faster and more efficient method. The disclosed designs may reduce the costs and deficiencies associated with prior art bridges and bridge construction.

Advantageously, the modules may be used for bridges intended to be used for heavy weights, including, for example, military vehicles such as tanks.

One of ordinary skill in the art will appreciate that the detailed description of the various embodiments is exemplary in nature, and that further embodiments and variations can be realized without departing from the spirit and scope of the invention, which is to be understood with reference to associated patent claims. It is to be understood that the invention is not limited to the specific embodiments described. One of ordinary skill in the art will appreciate, for example, that the structures disclosed may be formed alternatively from a single component, or multiple subcomponents. Likewise it will be appreciated that although reference has been made to a specific example of using RSC, one of ordinary skill in the art would understand that the structures disclosed could be formed using other plastics. One of ordinary skill will appreciate that the structures described herein may be adapted to a set of design parameters corresponding to a particular need for a bridge or other civil structure without departing from the scope and spirit of the invention.

In certain aspects and embodiments, disclosed is a composite action support module for use in civil infrastructure. The module includes a first elongate member for providing load bearing capability, the elongate member being made of a plastic material and having a first surface and a second surface. The module further includes a first cover plate made of a plastic material and extending along at least a portion of the length of the first elongate member, the first cover plate having a first surface and a second surface, at least a portion of the second surface of the first cover plate mated to at least a portion of the first surface of the first elongate member. The module further includes a plurality of panels made of a plastic material, each of the plurality of panels extending longitudinally between a first and a second end, and having a first surface and a second surface, and disposed at an angle to the first cover plate, at least a portion of the second surface of each of the plurality of panels mating with at least a portion of the first surface of the first cover plate. In the module, the first elongate member, the first cover plate and the plurality of panels form a structural unit having a load bearing surface formed from the first surfaces of the plurality of panels, with the panels adapted to be supported by the first elongate member via the first cover plate.

In further aspects and embodiments, disclosed is a method of forming a composite action support module for use in civil infrastructure. The method includes the step of mating a first elongate member made of a plastic material to a first cover plate made of a plastic material. The first elongate member has a first surface and a second surface and the first cover plate has a first surface and a second surface. The step of mating includes mating at least a portion of the first surface of the first elongate member to at least a portion of the second surface of the first cover plate, with the first cover plate extending along at least a portion of the length of the first elongate member. The method further includes a step of mating a plurality of panels made of a plastic material to the first cover plate. Each of the plurality of panels extends from a first end to a second end, and has a first surface and a second surface. This step of mating further includes mating at least a portion of the second surface of each of the plurality of panels to at least a portion of the first surface of the first cover plate, each of the plurality of panels being disposed at an angle to the first cover plate. The mating of the first elongate member, the first cover plate and the plurality of panels provides composite action between them to collectively form a load bearing structural unit.

In further aspects and embodiments, disclosed is a method of constructing civil infrastructure using a plurality of composite action support modules. The method includes the step of receiving a plurality of composite action support modules at the construction site for the civil infrastructure. Each of the support modules has a first elongate member for providing load bearing capability, the first elongate member being made of a plastic material and having a first surface and a second surface. Each of the support modules further has a first cover plate made of a plastic material and extending along at least a portion of the length of the first elongate member. The first cover plate has a first surface and a second surface, with at least a portion of the second surface mated to at least a portion of the first surface of the first elongate member. Each of the support modules further has a plurality of panels made of a plastic material. Each of the panels extends between a first end and a second end, and has a first surface and a second surface. Each of the panels is disposed at an angle to the first cover plate. At least a portion of the second surface of each of the panels mates with at least a portion of the first surface of the first cover plate. The first elongate member, the first cover plate and the plurality of panels form a structural unit having a load bearing surface formed from the first surfaces of the plurality of panels. The plurality of panels are adapted to be supported by the first elongate member via the first cover plate. The method includes the further step of joining, at the construction site, the plurality of composite action support modules such that the first surfaces of the plurality of panels for each of the modules form a substantially coplanar platform suitable for bearing load.

In some embodiments, the plastic material used to form at least one of the first elongate member, the first cover plate and the plurality of panels includes thermoplastic. In some embodiments, the plastic material used to form at least one of the first elongate member, the first cover plate and the plurality of panels includes recycled plastic composite.

In some embodiments, the distance from the first end to the second end of each of the plurality of panels is greater than the width of the first elongate member by a distance that is at least the width of the first elongate member and the module is configured such that the first elongate member is the primary elongate member that provides load bearing support to the plurality of panels.

In some embodiments, the module further includes a second elongate member disposed parallel to the first elongate member. The second elongate member has a first surface and a second surface and provides load bearing capability. The module further includes a second cover plate extending along at least a portion of the length of the second elongate member. The second cover plate has a first surface and a second surface, at least a portion of the second surface of the second cover plate being mated to at least a portion of the first surface of the second elongate member.

In some embodiments, the distance from the first end to said second end of each of the plurality of panels is greater than the combined width of the first and the second elongate members by a distance that is at least the width of the first elongate member. The module is configured such that the first and second elongate members are the primary elongate members that provide load bearing support to the plurality of panels.

In some embodiments, the module is adapted to be joined with one or more other composite action support modules to form a load bearing structure. In some embodiments, the load bearing structure is a bridge.

We claim:

1. A composite action support module for use in civil infrastructure, comprising:

a first elongate member for providing load bearing capability, said elongate member being made of a plastic material and having a first surface and a second surface;

a first cover plate made of a plastic material and elongate, extending longitudinally along at least a portion of the length of said first elongate member, said first cover plate having a first surface and a second surface, at least a portion of the second surface of said first cover plate mated to at least a portion of said first surface of said first elongate member; and a plurality of panels made of a plastic material, each of said plurality of panels extending longitudinally between a first and a second end, having a first surface and a second surface, and disposed at an angle that is offset to said first cover plate, at least a portion of the second surface of each of said plurality of panels mating with at least a portion of said first surface of said first cover plate, wherein said first elongate member, said first cover plate and said plurality of panels form a structural unit having a load bearing surface formed from said first surfaces of said plurality of panels, said panels adapted to be supported by said first elongate member via said first cover plate.

2. The composite action support module of claim 1, wherein the plastic material used to form at least one of said first elongate member, said first cover plate and said plurality of panels includes thermoplastic.

3. The composite action support module of claim 1, wherein the plastic material used to form at least one of said first elongate member, said first cover plate and said plurality of panels includes recycled plastic composite.

4. The composite action support module of claim 1, wherein the distance from said first end to said second end of each of said plurality of panels is greater than the width of said first elongate member by a distance that is at least the width of said first elongate member and wherein said module is configured such that said first elongate member is the primary elongate member that provides load bearing support to said plurality of panels.

5. The composite action support module of claim 1, further comprising a second elongate member disposed parallel to and abutting said first elongate member, said second elongate member having a first surface and a second surface and providing load bearing capability, and a second cover plate that is elongate and extending longitudinally along at least a portion of the length of said second elongate member, said second cover plate having a first surface and a second surface, at least a portion of said second surface of said second cover plate being mated to at least a portion of said first surface of said second elongate member.

6. The composite action support module of claim 5, wherein the distance from said first end to said second end of each of said plurality of panels is greater than the combined width of said first and said second elongate members by a distance that is at least the width of said first elongate member, and wherein said module is configured such that said first and said second elongate members are the primary elongate members that provide load bearing support to said plurality of panels.

7. The composite action support module of claim 1, adapted to be joined with one or more other composite action support modules to form a load bearing structure.

8. The composite action support module of claim 7, wherein said load bearing structure is a bridge.

9. A method of forming a composite action support module for use in civil infrastructure, comprising steps:

mating a first elongate member made of a plastic material to a first cover plate that is elongate and made of a plastic material, the first elongate member having a first surface and a second surface and the first cover plate having a first surface and a second surface, said mating including mating at least a portion of said first surface of said first elongate member to at least a portion of said second surface of said first cover plate, with the first cover plate extending longitudinally along at least a portion of the length of said first elongate member;

mating a plurality of panels made of a plastic material to said first cover plate, each of said plurality of panels extending from a first end to a second end, and having a first surface and a second surface, wherein said mating includes mating at least a portion of said second surface of each of the plurality of panels to at least a portion of said first surface of said first cover plate, each of said plurality of panels being disposed at an angle that is offset to said first cover plate, wherein the mating of said first elongate member, said first cover plate and said plurality of panels provides composite action between them to collectively form a load bearing structural unit.

10. The method of claim 9, wherein the plastic material used to form at least one of said first elongate member, said first cover plate and said plurality of panels includes thermoplastic.

11. The method of claim 9 wherein the plastic material used to form at least one of said first elongate member, said first cover plate and said plurality of panels includes recycled thermoplastic composite.

12. The method of claim 9, wherein the distance from said first end to said second end of each of said plurality of panels is greater than the width of said first elongate member by a distance that is at least the width of said first elongate member and wherein said module is configured such that said first elongate member is the primary elongate member that provides load bearing support to said plurality of panels.

13. The method of claim 9, further comprising providing a second elongate member disposed parallel to and abutting said first elongate member, said second elongate member having a first surface and a second surface and providing load bearing capability;

providing a second cover plate that is elongate, extending longitudinally along at least a portion of the length of said second elongate member, said second cover plate having a first surface and a second surface; and mating said second elongate member to said second cover plate by mating at least a portion of said second surface of said second cover plate to at least a portion of said first surface of said second elongate member.

14. The composite action support module of claim 5, wherein the distance from said first end to said second end of each of said plurality of panels is greater than the combined width of said first and said second elongate members by a distance that is at least the width of said first elongate member, and wherein said module is configured such that said first and said second elongate members are the primary elongate members that provide load bearing support to said plurality of panels.

15. A method of constructing civil infrastructure using a plurality of composite action support modules, comprising steps:

receiving a plurality of composite action support modules at the construction site for said civil infrastructure, each of said support modules having:

a first elongate member for providing load bearing capability, the first elongate member being made of a plastic material and having a first surface and a second surface, a first cover plate made of a plastic material and extending along at least a portion of the length of said first elongate member, the first cover plate having a first surface and a second surface, with at least a portion of the second surface mated to at least a portion of said first surface of said first elongate member; and a plurality of panels made of a plastic material, each of said panels extending between a first end and a second end, and having a first surface and a second surface, and disposed at an angle to said first cover plate, wherein at least a portion of said second surface of each of said panels mates with at least a portion of said first surface of said first cover plate, and wherein said first elongate member, said first cover plate and said plurality of panels form a structural unit having a load bearing surface formed from said first surface of said plurality of panels, said panels adapted to be supported by said first elongate member via said first cover plate; and joining, at said construction site, said plurality of composite action support modules such that the first surfaces of said plurality of panels for each of said modules form a substantially coplanar platform suitable for bearing load.

16. The method of claim 15, wherein the plastic material used to form at least one of said first elongate member, said first cover plate and said plurality of panels includes thermoplastic.

17. The method of claim 15, wherein the plastic material used to form at least one of said first elongate member, said first cover plate and said plurality of panels includes recycled thermoplastic composite.

18. The method of claim 15, wherein the distance from said first end to said second end of each of said plurality of panels is greater than the width of said first elongate member by a distance that is at least the width of said first elongate member and wherein said module is configured such that said first elongate member is the primary elongate member that provides load bearing support to said plurality of panels.

19. The method of claim 15, wherein the distance from said first end to said second end of each of said plurality of panels is greater than the combined width of said first elongate member and one or more further elongate member disposed parallel and adjacent to said first elongate member by a distance that is at least the width of said first elongate member, said first elongate member abutting at least one of said one or more further elongate members, and wherein said module is configured such that said first and said one or more further elongate members are the primary elongate members that provide load bearing support to said plurality of panels.

20. The method of claim 15, wherein said civil infrastructure is a bridge.

* * * * *